US011425953B2

(12) United States Patent
Rose

(10) Patent No.: US 11,425,953 B2
(45) Date of Patent: Aug. 30, 2022

(54) FACE SHIELD FOR BASEBALL CAP

(71) Applicant: Extang Corporation, Ann Arbor, MI (US)

(72) Inventor: Brent Lorenz Rose, Jefferson, GA (US)

(73) Assignee: EXTANG CORPORATION, Ann Arbor, MI (US)

( * ) Notice: Subject to any disclaimer, the term of this patent is extended or adjusted under 35 U.S.C. 154(b) by 77 days.

(21) Appl. No.: 16/898,770

(22) Filed: Jun. 11, 2020

(65) Prior Publication Data

US 2021/0386155 A1 Dec. 16, 2021

(51) Int. Cl.
*A42B 3/22* (2006.01)
*A41D 13/11* (2006.01)
*A42B 1/0182* (2021.01)

(52) U.S. Cl.
CPC ..... *A42B 3/225* (2013.01); *A41D 13/1184* (2013.01); *A42B 1/0182* (2021.01)

(58) Field of Classification Search
CPC ..... A42B 3/225; A42B 2/0182; A42B 3/20; A41D 13/1184; A41D 13/1161
USPC ..... 2/410, 9
See application file for complete search history.

(56) References Cited

U.S. PATENT DOCUMENTS 2,248,331 A * 7/1941 Blodjer ..... A42B 1/0182 2/10
3,419,907 A * 1/1969 Zahn ..... A61F 9/06 2/10
3,605,115 A * 9/1971 Bohner ..... A42B 3/225 2/10
3,763,495 A * 10/1973 De Angelis ..... A61F 9/06 2/8.1
4,063,740 A * 12/1977 Mader ..... A63B 69/3608 473/210
5,450,629 A * 9/1995 Gilstrap ..... A61F 9/045 2/209.11
5,473,778 A * 12/1995 Bell ..... A42B 1/247 2/10
5,673,431 A * 10/1997 Batty ..... A42B 1/0181 2/9
6,385,776 B2 * 5/2002 Linday ..... A42B 1/205 2/171.1
D526,446 S * 8/2006 Cowan ..... D29/109
9,894,952 B2 * 2/2018 Hayes ..... A42B 1/0182
D925,129 S * 7/2021 Wilson ..... D29/110
11,147,323 B1 * 10/2021 Wilson ..... A42B 3/225
2009/0193564 A1 * 8/2009 Niedrich ..... A42B 1/0184 2/173

(Continued)

OTHER PUBLICATIONS https://www.inc.com/leigh-buchanan/face-shields-coronavirus-protection-open-source.html, website accessed Jun. 10, 2020.

(Continued)

*Primary Examiner* — Gloria M Hale
(74) *Attorney, Agent, or Firm* — The Dobrusin Law Firm, P.C.; Bryan S. Lemanski

(57) ABSTRACT

A face shield comprising: a shield having a perforation that receives a brim of a baseball cap, and a pair of tabs extending from the shield that engage opposing sides of an inner portion of the baseball cap. Each tab may include a projection extending away from the base, and the projection may be inserted into a sweatband within the baseball cap.

19 Claims, 3 Drawing Sheets

(56) References Cited

U.S. PATENT DOCUMENTS

| | | | | |
|---|---|---|---|---|
| 2013/0031693 | A1* | 2/2013 | Gleason | A42B 3/225 2/9 |
| 2013/0125292 | A1* | 5/2013 | Weaver | A42B 1/0184 2/209.13 |
| 2016/0050990 | A1* | 2/2016 | Hayes | A42B 1/0182 2/9 |
| 2020/0281301 | A1* | 9/2020 | Wynalda, Jr. | A42B 1/0181 |
| 2021/0298380 | A1* | 9/2021 | Brown, II | A41D 13/1161 |

OTHER PUBLICATIONS https://www.instructables.com/id/COVID-19-Face-Shield/, website accessed Jun. 10, 2020.

https://www.google.com/url?sa=i&url=https%3A%2F%2Ftwitter.com%2Fcarlbass%2Fst2F1242654082986168320&psig=AOvVaw08c53ZFnn_XtvPtgG3FSrA&ust=158994426900:source=images&cd=vfe&ved=0CAIQiRxqFwoTCMiZj43vukCFQAAAAAdAAAAABAUå Website accessed Jun. 10, 2020.

https://www.youtube.com/watch?v=R04Tidt90yo, website accessed Jun. 10, 2020.

https://www.youtube.com/watch?v=fsU3wyLEL1I, website accessed Jun. 10, 2020.

http://go-mpsinc.com/contour/, website accessed Jun. 10, 2020.

https://liquidlaser.com/product/univeral-face-shield-bracket/, website accessed Jun. 10, 2020.

https://www.google.com/url?sa=i&url=https%3A%2F%2Faay.seamon.co%2Fproduct%2F40%2Foutdoor-epidemic-protection-hat-adjustable-face-shield-anti-spitting-protective-hat-cover&psig=AOvVaw0119GfM2AzunwdbX]o2Ygi&ust=1589945572880000&source=images=0CAIQiRxqFwoTCKCE3vr-vukCFQAAAAAdAAAAABAt¶ (website no longer available; last accessed May 29, 2020).

Instashield, 'InstaShield™—Father and Son Develop a Low Cost ace Shield for Your Baseball Cap,' https://www.youtube.com/watch?v=ySVeMRO35Zk, Jun. 8, 2020.

Instashield, 'InstaShield™—Face Shield for Your Hat—InstaShield', https//www.instashieldusa.com/, Jun. 8, 2020.

Canadian Office Action dated Nov. 25, 2021, Application No. 3,083,689.

* cited by examiner

FACE SHIELD FOR BASEBALL CAP

FIELD

The present teachings generally relate to a face shield, and more particularly, to a face shield for attachment to a baseball cap.

BACKGROUND

In many industries, it may be desirable for workers to wear personal protective equipment (PPE) to prevent liquids or airborne particulates from depositing on the face. For example, the PPE may be utilized to prevent airborne droplets from reaching a user's face, thereby preventing any airborne contagion contained within the droplets from infecting the wearer of the PPE. One particular type of PPE frequently used in the medical field or in manufacturing facilities is a face shield.

The face shields may be worn so that the shield covers a user's face almost entirely. The face shields may often include a headband or arms that wrap around a user's head and secure the face shield. Often, the face shields may be worn like a pair of eyeglasses by situating arms of the face shield above a user's ears. However, manufacturing of wearable face shield requires additional time and resources that may not be readily available. Additionally, the face shields often present a problem for user's trying to wear other headwear since the face shield may require said headwear to be removed.

To combat the aforementioned difficulties, face shields have been designed to secure directly to a user's existing headwear, such as a baseball cap. The face shield may in various manners be connected to a portion of the baseball cap, such as the brim. Advantageously, this allows a user to still wear their own personal headwear, yet still be protected by a face shield. However, these types of face shields are often flimsy, not durable, easily disconnect from the baseball cap or other headwear, or a combination thereof, thereby substantially decreasing the effectiveness of the face shield. Additionally, these types of face shields often cannot extend around the headwear to fully protect a user.

Thus, there remains a need for a lightweight and cost-effective face shield. What is needed is a face shield that connects to a user's existing headwear free of cost-prohibitive connection features. There also remains a need for a face shield that securely engages a user's headwear to prevent unwanted detachment of the face shield. What is needed is a face shield the engages and applies a force on a brim of a baseball cap to maintain a position of the face shield. Furthermore, there remains a need for a face shield that fully protects a user's face when secured to the user's headwear. Thus, what is needed is a face shield the includes one or more tabs to connect the face shield to the user's headwear so that the face shield at least partially extends along sides of the user's face.

SUMMARY

The present teachings meet one or more of the present needs by providing a face shield comprising: a shield having a perforation that receives a brim of a baseball cap, and a pair of tabs extending from the shield that engage opposing sides of an inner portion of the baseball cap.

The tabs may extend away from, and may be connected to, the shield by a base. Each tab may include a projection extending away from the base, and the projection may be inserted into a sweatband within the baseball cap. The projections may include a tine having a sharp terminal point that engages the sweatband to maintain a position of the face shield relative to the baseball cap. Additionally, each tab may be folded along a fold line so that a folded portion is secured within a sweatband of the baseball cap. The fold line may include perforations, a score line, a localized decrease in material thickness, or a combination thereof.

The present teachings meet one or more of the present needs by providing a face shield, wherein: the perforation is a wave-like shape that includes an engaging portion that abuts the brim; the perforation includes a plurality of engaging portions that apply a clamping force on opposing surfaces of the brim; the perforation includes cutouts located near opposing ends of the perforation; the cutouts are teardrop shaped to receive the brim in a bent condition; wherein the shield extends downwardly from the brim to cover the face of a user wearing the baseball cap once the face shield is secured to the baseball cap; the fold line extends substantially perpendicular to the base along an entire width of the base; each tab includes a pair of projections extending away from the base in opposing directions substantially perpendicular to the base; the face shield connects to and disconnects from the baseball cap free of any damage, manipulation, or both to the baseball cap; a length of the perforation is greater than or substantially equal to a width of the brim; or a combination thereof.

Furthermore, the present teachings meet the present needs by providing a face shield comprising: (a) a shield having a perforation along an interior portion that extends through a thickness of the shield; (b) a first tab connected to the shield by a base and extending away from the shield; and (c) a second tab connected to the shield by a base and extending away from the shield; wherein the perforation, the first tab, and the second tab are each connected to a baseball cap to connect the face shield to the baseball cap.

The perforation may be secured around a brim of the baseball cap. The first tab and the second tab may be secured within a sweatband located along an interior of the baseball cap, and the first tab and the second tab may be positioned near opposing sides of the baseball cap. Additionally, the first tab and the second tab may be secured within the sweatband by folding a projection of each tab along a fold line and inserting the projection into the sweatband. Moreover, the projection may include a tine having a sharp point that engages an inner side of the sweatband to maintain a position of the face shield relative to the baseball cap.

The present teachings meet one or more of the present needs by providing: a lightweight and cost-effective face shield; a face shield that connects to a user's existing headwear free of cost-prohibitive connection features; a face shield that securely engages a user's headwear to prevent unwanted detachment of the face shield; a face shield the engages and applies a force on a brim of a baseball cap to maintain a position of the face shield; a face shield the full protects a user's face when secured to the user's headwear; a face shield the includes one or more tabs to connect the face shield to the user's headwear so that the face shield at least partially extends along sides of the user's face; or a combination thereof.

DETAILED DESCRIPTION

Figure 1:
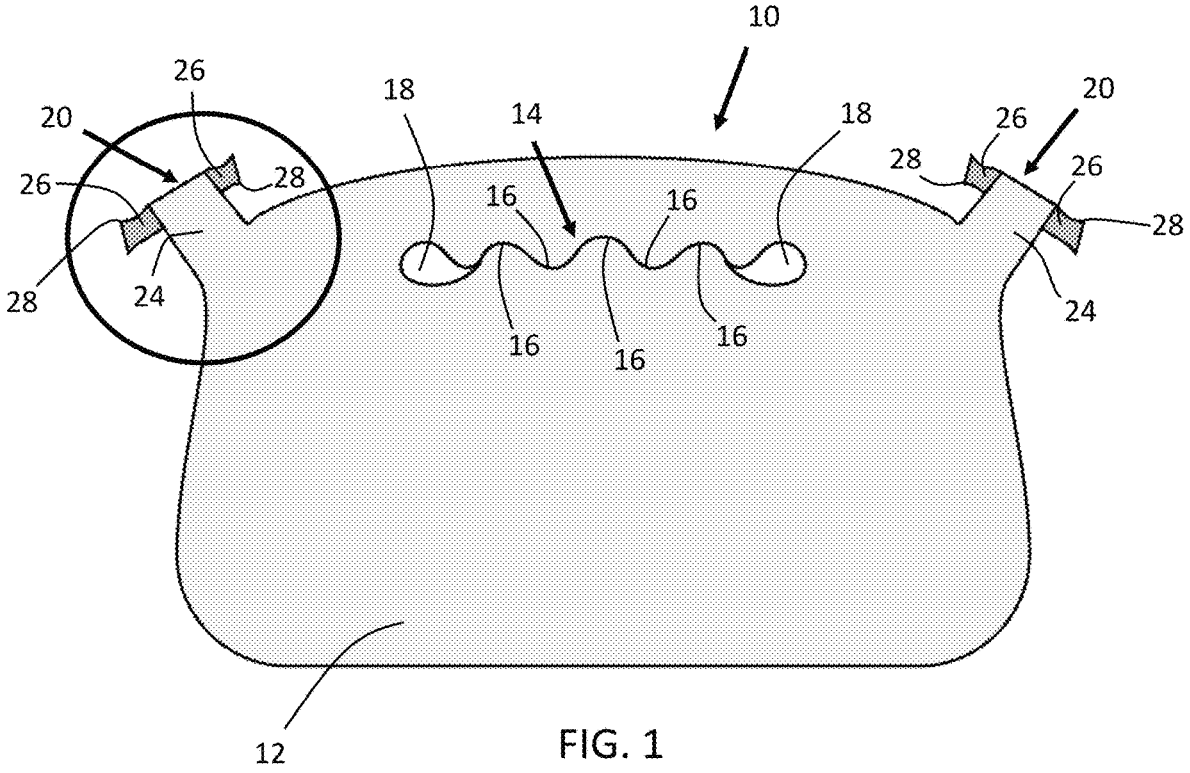
FIG. 1 is a perspective view of a face shield.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings generally relate to a face shield. The face shield may function to protect a user from debris, liquid, airborne particulates, or a combination thereof. The face shield may be wearable by a user to prevent debris, liquid, airborne particulates, or a combination thereof from reaching the user's face. For example, the face shield may substantially or entirely block an airborne contagion contained within droplets from reaching the user's face and potentially infecting the user with the contagion. Thus, it may be widely understood that the face shield may be any form of personal protective equipment (PPE) used by an individual to protect at least a portion of their body. However, it is envisioned that the face shield describe herein may be particularly useful in protecting a person's face, including their eyes, nose, mouth, ears, or a combination thereof.

The face shield may be worn by a user in a stand-alone manner. For example, the face shield may be connected to a band to secure the face shield to the user's head. The face shield may also include one or more arms, extensions, or other engagement features that facilitate attaching the face shield directly to a user's head.

However, the face shield may more beneficially connect to the existing headwear of a user. More particularly, the face shield may be secured to a baseball cap or other type of hat of a user. Therefore, the face shield may advantageously be retrofitted to a user's headwear without the need for additional connection means to secure the face shield directly to the user's head. While baseball caps are described herein, it is envisioned that the face shield may be secured to other types of headwear, such as a headband, other type of brimmed hat, beanie, visor, or a combination thereof.

The face shield described herein may be manufactured in high volumes due to its lightweight and monolithic design. For example, the face shield may be made from a single piece of material to decrease manufacturing costs, decrease parts, or both. The face shield may be cut from a single piece of plastic, polycarbonate, polyethylene terephthalate (PET), biaxially-oriented polyethylene terephthalate (BoPET), other materials, or a combination thereof. Thus, given the cost effectiveness of the face shield described herein, the face shield may be disposable (i.e., single use). However, it is envisioned that the face shield may also be removable for cleaning and/or disinfecting so that a user may get multiple uses of the face shield.

The face shield may include a shield. The shield may be the primary portion of the face shield that functions to protect a user's face and/or body from environmental contaminants. The face shield, once attached to a user's headwear, may extend downwardly in front of the user's face. While the face shield may extend downward from a user's forehead at any desired length, it is contemplated that the face shield extend at least to or beyond a user's chin to protect the user more fully.

The shield may be substantially planar or may be contoured. For example, the shield may contour around a portion of the user's headwear to at least partially protect the sides of a user's face, such as their ears and cheeks. Therefore, the shield may be flexible to allow for bending of the shield. Accordingly, the shield may vary in thickness and dimensions to accommodate different headwear, desired protection, flexibility, or a combination thereof. For example, a thicker shield may be utilized when the face shield needs to prevent debris from reaching a user's face—using a thinner material thickness may risk debris puncturing the shield and injuring the user.

The shield may be at least partially transparent so that a user may maintain a line of sight while using the face shield. However, the shield may include a hue or tint based on a given application. For example, the shield may be tinted for outdoor use to protect a user at least partially from the sun and help maintain visibility. Therefore, it also contemplated that the shield may provide at least partial ultraviolet (UV) protection.

The shield may include one or more perforations. The perforation may function to at least partially secure the face shield to a user's headwear. More particularly, the perforation may connect to a brim of a baseball cap. For example, the brim may be inserted and extended through the perforation to maintain a position of the face shield. The perforation may thus extend through a thickness of the shield to allow the brim to extend entirely through the shield.

The perforation may be positioned anywhere along the shield. However, as described herein, the perforation may be located along an inner portion of the shield away from any terminal edges. The perforation may be positioned along a central axis so that the face shield is substantially centered once connected to the headwear of the user. However, it should be noted that the perforation may be off centered to accommodate different configurations.

The perforation may vary in length and/or dimensions. The perforation may have a length at least substantially equal to a width of the brim of a baseball cap so that the brim may easily extend through the perforation. The perforation may have a length greater than a width of the brim of a baseball cap. The perforation may also have a length less than a width of the brim of a baseball cap.

The perforation may be substantially linear. The perforation may include one or more arcuate segments, one or more undulations, one or more steps, one or more angles, one or more teeth, or a combination thereof. For example, the perforation may be substantially nonlinear and have a wave-like shape. Alternatively, the perforation may include one or more sharp bends and/or angles so that the perforation includes a plurality of sharp teeth.

The perforation may include one or more engaging portions. The engaging portions may function to engage the brim of a baseball cap or another portion of a user's headwear. The engaging portions may be dictated by a shape of the perforation. For example, if the perforation has a wave-like shape, the "peaks" of each "wave" may be an engaging portion that physically engages the brim of the baseball cap. However, it should be noted that any portion of the perforation may be an engaging portion.

The engaging portions may apply a force to the brim of the baseball cap to maintain a position of the shield. The engaging portions may apply a force to one or more surfaces of the brim. The engaging portions may be positioned on opposing surfaces of the brim (e.g., an upper surface and a lower surface) to apply a clamping force on the force. Therefore, the engaging portions may be located substantially in line with one another to provide the clamping force, or may be offset from each other.

The engaging portions may be flexible, may be substantially rigid, or both. The engaging portions facilitate easy insertion of the brim of a baseball cap into the perforation, yet substantially prevent unwanted removal of the brim from the perforation. However, advantageously the engaging portions described herein may allow for the brim to be inserted and removed from the perforation free of any damage or permanent distortion.

The perforation may also include one or more cutouts. The cutouts may function to receive at least a portion of the brim of the baseball cap. The cutouts may allow the perforation to be secured to a variety of brims having different dimensions. The cutouts may allow for the perforation to open and receive the brim of the baseball cap without damage or tearing of the face shield, without damaging the baseball cap, or both.

The cutouts may be an absence of material along the shield. For example, the cutouts may be formed by removing a segment of material along the perforations to provide an opening. The opening of the cutout may be any desired size and/or shape, such as a teardrop, rectangle, oval, circle, square, or a combination thereof. The cutouts may be positioned anywhere along the perforation. The cutout may be positioned near opposing ends of the perforation to accommodate various types of brims.

Once the brim is inserted, the cutouts may be substantially or entirely free of contact with the headwear of the user. Thus, the engaging portions of the perforation may maintain a position of the face shield without the cutouts engaging the brim. However, the cutouts may also at least abut a portion of the brim, such as one or more edges of the brim.

The face shield may be secured to the baseball cap entirely by the perforation. However, it is envisioned that the face shield may also be connected to the baseball cap by one or more tabs. The tabs may function to secure the shield in a contoured manner around a user's face. The tabs may allow for the face shield to be flexed and then secured to the baseball cap in a flex state. Therefore, the tabs may advantageously provide further customization of the face shield when connecting to a baseball cap or other headwear of a user.

The tabs may connect to any portion of the baseball cap. The tabs may extend inwardly to connect to an inner portion of the baseball cap. For example, the tabs may be secured within a cap portion of the baseball cap between the baseball cap and the user's head. One point of connection may be the sweatband or headband located along an inner surface of the cap portion of the baseball cap that substantially contacts a user's head. Often the sweatband may include a fold or inner seam that may receive a portion of the tabs.

A single tab may be used or a plurality of tabs may secure the face shield to the baseball cap. For example, a first tab and a second tab may be positioned along opposing sides of the headband so that, once the baseball cap and face shield assembly is worn by a user, the first tab and the second tab are positioned on opposing sides of the user's head, such as by or near the user's ears.

The tab may be connected to and extend from the shield by a base. The base may function as a primary connection means between the tab and the shield. The base may provide structure integrity to the tab during operation to prevent tearing or fracturing of the tab from the shield. The base may be tapered or may include a substantially uniform structure. The base may be positioned at any desired angle relative to the shield. The base may project in any desired direction relative to the shield.

The base may connect one or more projections of the tab to the shield. The projections may function to engage the baseball cap and secure the tabs to the baseball cap. The projections may extend from the base in any desired direction. However, it is envisioned that the projections may extend substantially perpendicular away from the base. As such, the projections may be inserted into the sweatband of the baseball cap so that a length of the projection engages an inner surface of the sweatband. A length of the projection may run along the sweatband to engage a greater area of the sweatband and prevent unwanted disconnection of the tab from the baseball cap.

Each tab may include a single projection or may include a plurality of projections. For example, the tab may include a pair of projections that extend away from the base in opposing directions. Thus, the tabs may beneficially engage an even great surface area of the sweatband to prevent unwanted disconnection of the tab.

The projections may extend in any desired direction. The projections may be any desired shape. However, it is envisioned that the projections may be substantially or fully recessed from a terminal edge of the sweatband once inserted. Therefore, the projections may be free of direct contact with a user's head to prevent discomfort.

The projections may also include one or more tines. The tines may function to further engage the baseball cap. The tines may be located along the projections to connect the tabs to the sweatband. The tines may be a substantially sharp point or edge of the projections. The tines may pierce of engage the fabric of the sweatband to prevent disconnection of the tabs. However, the tines may beneficially engage and disengage the sweatband or other portions of the baseball cap free of damage to the baseball cap, snagging of the fabric of the baseball cap, damage to the tabs, or a combination thereof.

The tines may be teeth along the projections. The tines may be located along a peripheral edge of the projections. The tines may be located at an end point of the projections. The tines extend from the projection. Alternatively, or additionally, the tines may be a notch or other recess along the projection that forms a sharp edge.

Each projection may include a plurality of tines or may include only a single tine. Alternatively, the projections may be free of any tines and engage the baseball cap with a shape of the projections.

The projections may be folded along a fold line so that the projections and/or another portion of the tab may be inserted into the sweatband. The fold line may extend along all or a portion of the tab. The fold line may extend along the base. For example, the fold line may extend across a width of the base. The fold line may extend along an entire width or a portion of the width of the base.

It is envisioned that the fold lines may ensure a consistent fold of the tabs by a user during installation. The fold lines may include perforations, scoring, notching, a localized decrease in material thickness, or a combination thereof to ensure consistent folding at substantially the same location each time. Thus, the fold lines may help maintain similar folds among multiple tabs of the same face shield.

The fold line may be located at a position between the base and the projections. Thus, the projections may be folded relative to the base. However, the fold line may be located anywhere along the tab to allow at least a portion of the tab to be folded. The folded portion may then be secured within the sweatband of the baseball cap. As such, the folded portion may include one or more perforations, one or more tines, a portion of the base, or a combination thereof.

Turning now to the figures, FIG. 1 illustrates a perspective view of a face shield 10. The face shield 10 may attach to a hat, such as a baseball. The face shield 10 includes a shield 12 configured to protect a user's face during operation once secured the shield 12 is secured to the hat and the user is wearing the hat (see FIG. 4). The face shield 10 further includes a perforation 14 located along the shield 12. As illustrated, the perforation 14 may be located inwardly from one or more peripheral edges of the shield 12. However, it should be noted that the perforation 14 may be positioned anywhere along the shield 12 to accommodate different hats and/or different shield 12 dimensions. For example, the perforation 14 may be positioned near a top-most peripheral edge of the shield 12 closest to the brim of a hat so that the shield 12 extends farther downward away from the brim to protect a user's face.

The perforation 14 may vary in size and/or shape. However, it is envisioned that the perforation 14 may have a wave-like shape. Accordingly, the perforation 14 may include one or more engaging portions 16 that engage the brim of a hat to secure the face shield 10 in a desired location, prevent unwanted disconnection of the face shield 10 from a hat, or both. It is envisioned that the engaging portions 16 may engage opposing surface of the brim to apply a clamping force on the brim. As shown, the engaging portions 16 may be located adjacent to one along a length of the perforation 14. However, the perforations 14 may also be located directly across from one another if desired. Additionally, the perforation 14 may include one or more cutouts 18 that allow the brim of a hat to be inserted into the perforation 14. As illustrated, the cutouts 18 may be teardrop shaped to allow the brim of a hat to be inserted into the perforation 14 so that the shield may at least partially bend and follow contour of the brim (see, e.g., FIG. 4).

The face shield 10 may further include a pair of tabs 20. Each tab 20 may extend from the shield 12 along a base 24. A length of the bases 24 may be adjusted to accommodate different hat shapes and/or dimensions. Each tab 20 be folded along a fold line to secure the tabs 20 to a portion of the hat (see FIGS. 2A and 2B). The tabs 20 may further include one or more projections 26 extending away from the base 24. Each projection 26 may extend in any desired direction. However, as illustrated, the projections 26 may beneficially extend away from the base 24 to engage a greater surface area of a sweatband of a hat (see FIG. 4). Furthermore, each perforation 26 may include a plurality of tines 28 positioned near terminal corners. The tines 28 may have a substantially sharp terminal point to engage a portion of a hat, such as an inner surface of a sweatband. While the tines 28 are shown as a sharp terminal point, the tines 28 may be located anywhere along the projections 26 and be any desired shape.

Figure 2A:
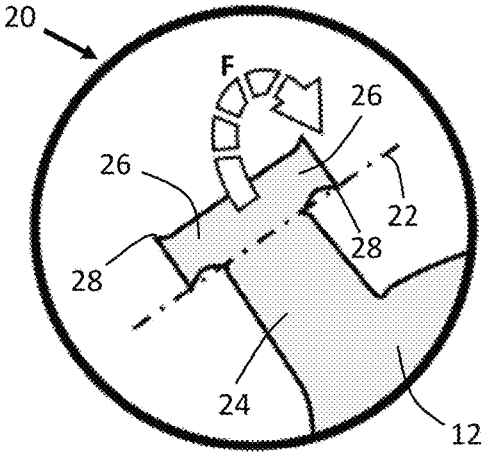
FIG. 2A is a close-up view of the tab of FIG. 1 in an unfolded position.
Figure 2B:
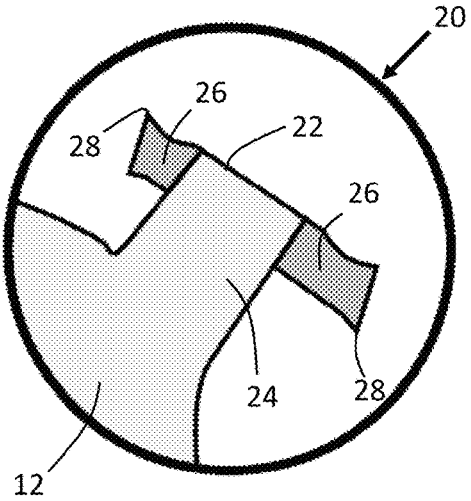
FIG. 2B is close-up view of the tab of FIG. 2A in a folded position.

FIGS. 2A and 2B illustrate a close-up view of the tab 20 of FIG. 1 in an unfolded state and a folded state, respectively. As shown, the tab 20 extends away from and connected to a shield 12 of the face shield 10 by a base 24. A pair of projections 26 extend in opposing directions away from the base 24 to engage a portion of a hat, such as a sweatband. Each projection 26 may include a plurality of tines 28 to secure the tab 20 to the hat. Each tine 28 may include a substantially sharp terminal point to engage a portion of the hat. For example, it is envisioned that the tines 28 may at least partially pierce the fabric of the sweatband of the hat to maintain a position of the face shield 10 relative to the hat. However, the tines 28 may also beneficially removably attach to the sweatband to allow for disconnection of the face shield 10 from the hat. The engagement and disengagement of the tines 28 may be completed without any distortion or permanent damage to the hat, such as a puncture hole, tearing or ripping of the fabric, snagging of the thread, or a combination thereof.

As shown in FIG. 2A, the tabs 20 may be in an unfolded state prior to installation of the face shield 10. During installation of the face shield 10 on a hat as shown in FIG. 2B, each tab 20 may be folded along a fold line 22 in a fold direction (F) so that the tab 20 may be inserted along a sweatband located inside a cap portion of the hat (see FIG. 4). The fold line 22 may include perforations to allow for easy manipulation of the tab 20 along the fold line 22, ensure consistent folds for each tab 20 during installation, or both. Additionally, it is contemplated that other features may be utilized instead of perforations to ensure consistent folding of the tabs 20. For example, the fold lines 22 may be scored or otherwise etched to create a localized decrease in material thickness. Alternatively, or additionally, the fold lines 22 may be manufactured to have a localized decrease in material thickness free of any secondary operation such as scoring or cutting.

As illustrated in FIGS. 2A and 2B, the fold lines 22 may be positioned substantially perpendicular to the base 24 and extend along a width of the base 24 of each tab 20 so that both projections 26 of each tab 20 may be folded simultaneously along the same fold line 22. Accordingly, the tabs 20 herein advantageously facilitate an expedited assembly process for connecting the face shield 10 to a baseball cap. However, it should be noted that each tab 20 may include more than a single fold line 22. For example, each tab 20 may include a separate fold line 22 for each projection 26.

Figure 3:
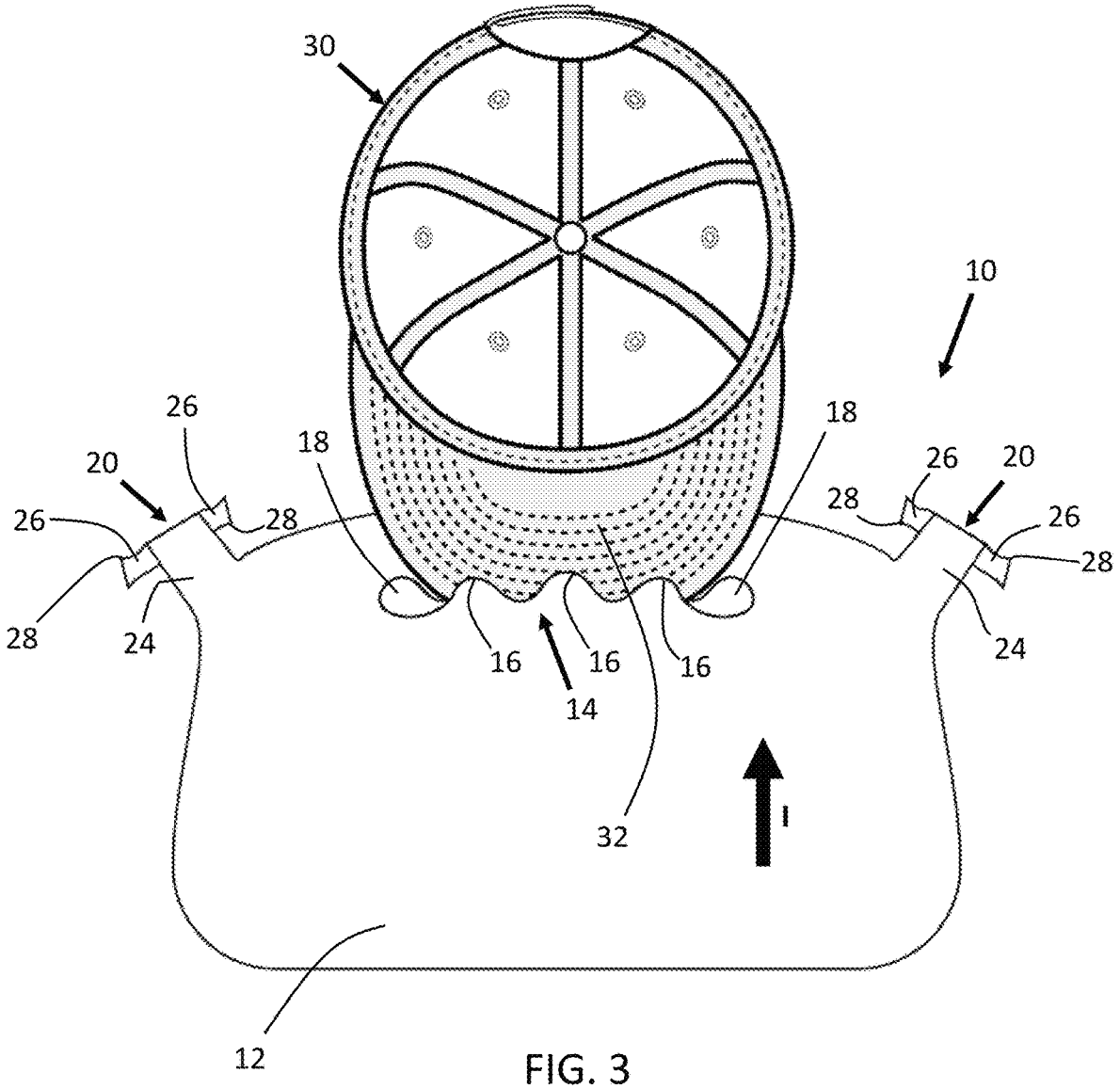
FIG. 3 is a bottom perspective view of a face shield being secured to a baseball cap.

FIG. 3 illustrates a perspective view of a face shield 10 being secured to a baseball cap 30. As discussed above, the face shield 10 includes a shield 12 designed to protect a user's face once the face shield 10 is secured the baseball cap 30. The shield 12 includes a perforation 14 through a thickness of the shield 12. As shown, the face shield 10 is inserted onto the baseball cap 30 in an insertion direction (I). During installation, a brim 32 of the baseball cap 30 is inserted into and through the perforation 14 so that a plurality of engaging portions 16 of the perforation 14 engage the brim 32. The engaging portions 16 may apply a force to opposing surfaces of the brim 32, such as a clamping force, to maintain a position of the face shield 10 during operation. The perforation 14 further includes cutouts 18 near opposing ends of the perforation 14. The cutouts 18 may allow the shield 12 to follow a contour of the brim 32. For example, the brim 32 of the baseball cap 30 may be at least partially bent and the shield 12 may substantially follow the bend of the brim 32. Additionally, as shown, a length of the perforation 14 may be greater than or substantially equal to a width of the brim 32.

Figure 4:
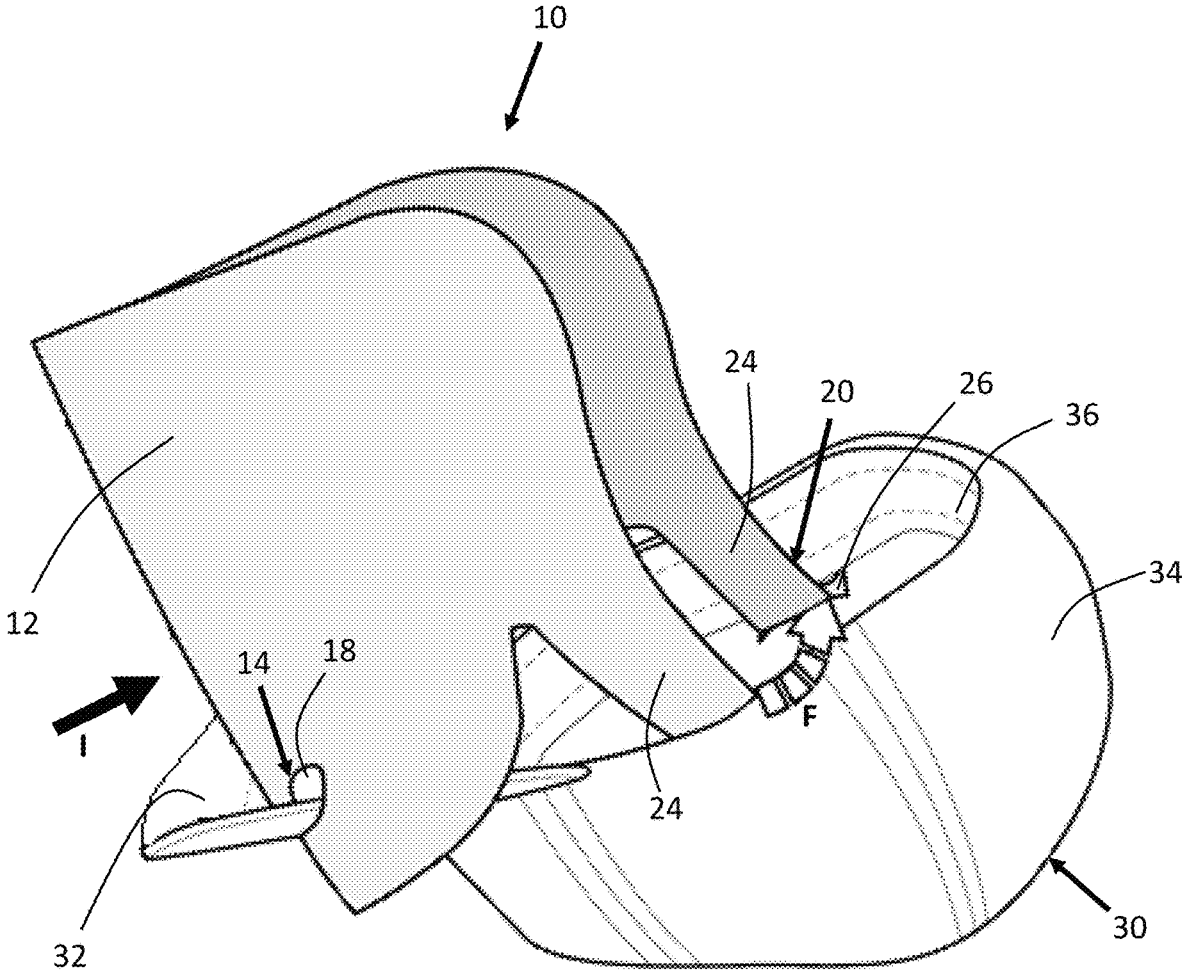
FIG. 4 is a perspective view of a face shield secured to a baseball cap.

The face shield 10 further includes a pair of tabs 20 that secure the face shield 10 to an inner portion of the baseball cap 30 (see FIG. 4). Each tab 20 is connected to the shield 12 by a base 24. Additionally, each tab 20 includes a pair of projections 26 extending in opposing directions from the base 24. The projections 26 may include a plurality of tines 28 to engage the inner portion of the baseball cap 30 maintain a contoured shape of the face shield 10 once installed.

FIG. 4 illustrates a perspective view of a face shield 10 attached to a baseball cap 30. The face shield 10 includes a shield 10 extending downward from a brim 32 of the baseball cap. A perforation 14 along the shield 10 extends around the brim 32 when moved in the insertion direction (I) to at least partially connect the face shield 10 to the baseball cap 30. The perforation 14 may also include one or more cutouts 18 that allow the face shield 10 to bend and follow a contour of the brim 32. As illustrated, the brim 32 may be folded into an arcuate segment. Advantageously, the face shield 10 may follow the arcuate segment of the brim 32 based upon the shape of the perforation 14 and the presence of the cutout 18.

After the brim 32 is inserted into the perforation 32, a pair of tabs 20 may be connected to an interior of a cap portion 34 of the baseball cap 30. Each tab 20 may extend from, and be connected to, the shield 12 by a base 24. The tabs 20 may be folded along a fold line in a fold direction (F) so that projections 26 of the tabs 20 may be inserted into a sweatband 36 of the cap portion 34. As discussed above, the projections 26 may include one or more tines to engage the sweatband 36 and maintain a position of the face shield 10. Furthermore, the tabs 20 may engage opposing sides of the sweatband 36 or other part of the cap portion 34 to be positioned on opposing sides of a user's head.

ELEMENT LIST

10 Face Shield
12 Shield
14 Perforation
16 Engaging Portion
18 Cutout
20 Tab
22 Fold Line
24 Base
26 Projection
28 Tine
30 Baseball Cap
32 Brim
34 Cap Portion
36 Sweatband
I Insertion Direction (of the Face Shield)
F Fold Direction (of the Tab)

The explanations and illustrations presented herein are intended to acquaint others skilled in the art with the invention, its principles, and its practical application. The above description is intended to be illustrative and not restrictive. Those skilled in the art may adapt and apply the invention in its numerous forms, as may be best suited to the requirements of a particular use.

Accordingly, the specific embodiments of the present invention as set forth are not intended as being exhaustive or limiting of the teachings. The scope of the teachings should, therefore, be determined not with reference to this description, but should instead be determined with reference to the appended claims, along with the full scope of equivalents to which such claims are entitled. The omission in the following claims of any aspect of subject matter that is disclosed herein is not a disclaimer of such subject matter, nor should it be regarded that the inventors did not consider such subject matter to be part of the disclosed inventive subject matter.

Plural elements or steps can be provided by a single integrated element or step. Alternatively, a single element or step might be divided into separate plural elements or steps.

The disclosure of "a" or "one" to describe an element or step is not intended to foreclose additional elements or steps.

While the terms first, second, third, etc., may be used herein to describe various elements, components, regions, layers and/or sections, these elements, components, regions, layers and/or sections should not be limited by these terms. These terms may be used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100+/−15.

The disclosures of all articles and references, including patent applications and publications, are incorporated by reference for all purposes. Other combinations are also possible as will be gleaned from the following claims, which are also hereby incorporated by reference into this written description.

What is claimed is:

1. A face shield comprising:

(a) a shield having a perforation that is configured to receive a brim of a baseball cap; and (b) a pair of tabs extending from the shield that are configured to engage opposing sides of an inner portion of the baseball cap, wherein each tab includes a projection extending away from the base that has a plurality of tines configured for insertion into a sweatband within the baseball cap, and each tine includes a sharp terminal point configured to engage the sweatband.

2. The face shield of claim 1, wherein each tab extends away from, and is connected to, the shield by a base.

3. The face shield of claim 2, wherein each tab is folded along a fold line so that a folded portion is configured to be secured within a sweatband of the baseball cap.

4. The face shield of claim 3, wherein the fold line includes perforations, a score line, a localized decrease in material thickness, or a combination thereof.

5. The face shield of claim 1, wherein the perforation is nonlinear in shape and includes an engaging portion that is configured to abut the brim.

6. The face shield of claim 5, wherein the perforation includes a plurality of engaging portions that are configured to apply a clamping force on opposing surfaces of the brim.

7. The face shield of claim 1, wherein the perforation includes cutouts located near opposing ends of the perforation.

8. The face shield of claim 7, wherein the cutouts are teardrop shaped and configured to receive the brim in a bent condition.

9. The face shield of claim 8, wherein the shield is configured to be secured to the baseball cap so that it extends downwardly from the brim to cover the face of a user wearing the baseball cap.

10. The face shield of claim 3, wherein the fold line extends substantially perpendicular to the base along an entire width of the base.

11. The face shield of claim 2, wherein each tab includes a pair of projections extending away from the base in opposing directions substantially perpendicular to the base.

12. The face shield of claim 1, wherein the face shield is configured to connect to and disconnect from the baseball cap.

13. The face shield of claim 1, wherein a length of the perforation is greater than or substantially equal to a width of the brim.

14. A face shield comprising:

(a) a shield having a perforation along an interior portion that extends through a thickness of the shield;

(b) a first tab connected to the shield by a base and extending away from the shield; and (c) a second tab connected to the shield by a base and extending away from the shield;

wherein the first tab and the second tab are configured to be secured within a sweatband located along an interior of a baseball cap by folding a projection of each tab along a fold line and inserting the projection into the sweatband, whereby each projection includes a sharp point that is configured to engage an inner side of the sweatband.

15. The face shield of claim 14, wherein the perforation is configured to be secured around a brim of the baseball cap.

16. The face shield of claim 15, wherein the first tab and the second tab are configured to be positioned near opposing sides of the baseball cap.

17. The face shield of claim 14, wherein the projection maintain a position of the face shield relative to the baseball cap.

18. The face shield of claim 15, wherein the perforation includes cutouts located near opposing ends of the perforation.

19. The face shield of claim 18, wherein the cutouts are teardrop shaped and configured to receive the brim in a bent condition.

* * * * *